US006918817B2

(12) United States Patent
Stuhlmacher, II

(10) Patent No.: US 6,918,817 B2
(45) Date of Patent: Jul. 19, 2005

(54) CLEANING TOOL AND METHOD

(76) Inventor: Glen Stuhlmacher, II, 45 Cuenca Ct., San Ramon, CA (US) 94583

( * ) Notice: Subject to any disclaimer, the term of this patent is extended or adjusted under 35 U.S.C. 154(b) by 0 days.

(21) Appl. No.: 10/684,305

(22) Filed: Oct. 11, 2003

(65) Prior Publication Data

US 2005/0079800 A1 Apr. 14, 2005

(51) Int. Cl.[7] ..... B24B 1/00

(52) U.S. Cl. ..... 451/28; 451/56; 451/443; 451/444; 451/523; 451/524

(58) Field of Search ..... 451/28, 56, 443, 451/444, 523, 524

(56) References Cited

U.S. PATENT DOCUMENTS 2,677,362 A * 5/1954 Back ..... 125/37
4,959,928 A * 10/1990 Hartwig, Sr. ..... 451/444
5,070,570 A * 12/1991 Sabo ..... 15/160
5,456,630 A * 10/1995 Kaiser et al. ..... 451/444

* cited by examiner

*Primary Examiner*—Joseph J. Hail, III
*Assistant Examiner*—Shantese L. McDonald

(57) ABSTRACT

A hand-held cleaning tool for foam buffing pads includes a paddled cleaning wheel mounted for rotation on a shaft attached to the end of a pistol grip handle. The paddle cleaning wheel grips the foam buffing pad. The cleaning tool is operated by holding the same in operative contact with the rotatably driven pad.

11 Claims, 4 Drawing Sheets

CLEANING TOOL AND METHOD

BACKGROUND OF THE INVENTION

The present invention pertains to a tool for cleaning a foam buffing pad, such as a rotary power driven one and, more particularly, to a hand held tool that may be held for example, against the driven pad to remove caked materials (e.g., paint, paint polishing compounds and the like).

Pads made from reticulated foams such as flexible polyurethane (e.g., obtained commercially from 3M®), have become very popular for use in the auto finishing industry. These pads are formed in a circular or cylindrical shape and mounted for power driven rotation. When used for buffing, waxing, polishing and the like, oxidized paint, and other soils build up on the surface of the pad, typically as a cake-like layer. However, if the pad surface can be cleaned and the edges and other portions of the pad dressed, the pads can be given substantially extended useful lives before they are worn to the point of discarding. This is commercially very desirable.

Removing the pad from the drive unit and dressing the same by hand with the use of water for example, is tedious and difficult. U.S. Pat. No. 5,456,630 discloses a hand tool for cleaning foam pads. As disclosed therein, a plurality of cleaning wheels are used to clean and dress the pad. The shortcoming of this device is that the wheels merely spin on the pad without actually cleaning the pad very efficiently.

There is a need in the art to have a hand held tool by which the buffing pad can be cleaned while operatively mounted and being rotatably driven. However, such tool should be constructed so it does not cause excessive tearing of the foam, and cleans the pads effectively and efficiently. The present tool fulfills these and other needs.

SUMMARY OF THE INVENTION

The present invention provides a hand held cleaning tool for foam buffing pads, comprising: a handle; a tool supporting end attached to and extending from one end of the handle; and a cleaning wheel mounted on a shaft attached to the tool supporting end. The handle is preferably in the form of a pistol grip. In one embodiment, the tool supporting end is formed integrally with the grip and extends angularly away from the grip in pistol-like fashion. A cleaning wheel is mounted on a common shaft which is attached to the tool supporting end. The cleaning wheel is preferably made from a material that grips the pad and preferably opens the pores of the foam pad. Preferred cleaning wheel materials include, for example a polymer or leather. The cleaning wheel is preferable in a paddle wheel configuration.

In another embodiment, the present invention provides a method for cleaning a soiled foam pad (e.g. buffing pad), comprising: contacting the soiled foam pad with a hand held cleaning tool having a paddle cleaning wheel, wherein the soiled foam pad is mounted and being rotatably driven; gripping the foam pad with the paddle cleaning wheel thereby cleaning the soiled foam pad. In a preferred embodiment, the paddle cleaning wheel cleans the foam pad in a carpet beating-like action.

These and other objects, advantages and embodiments will become more apparent when read with the accompanying figures and detained description.

DESCRIPTION OF THE INVENTION

Figure 1:
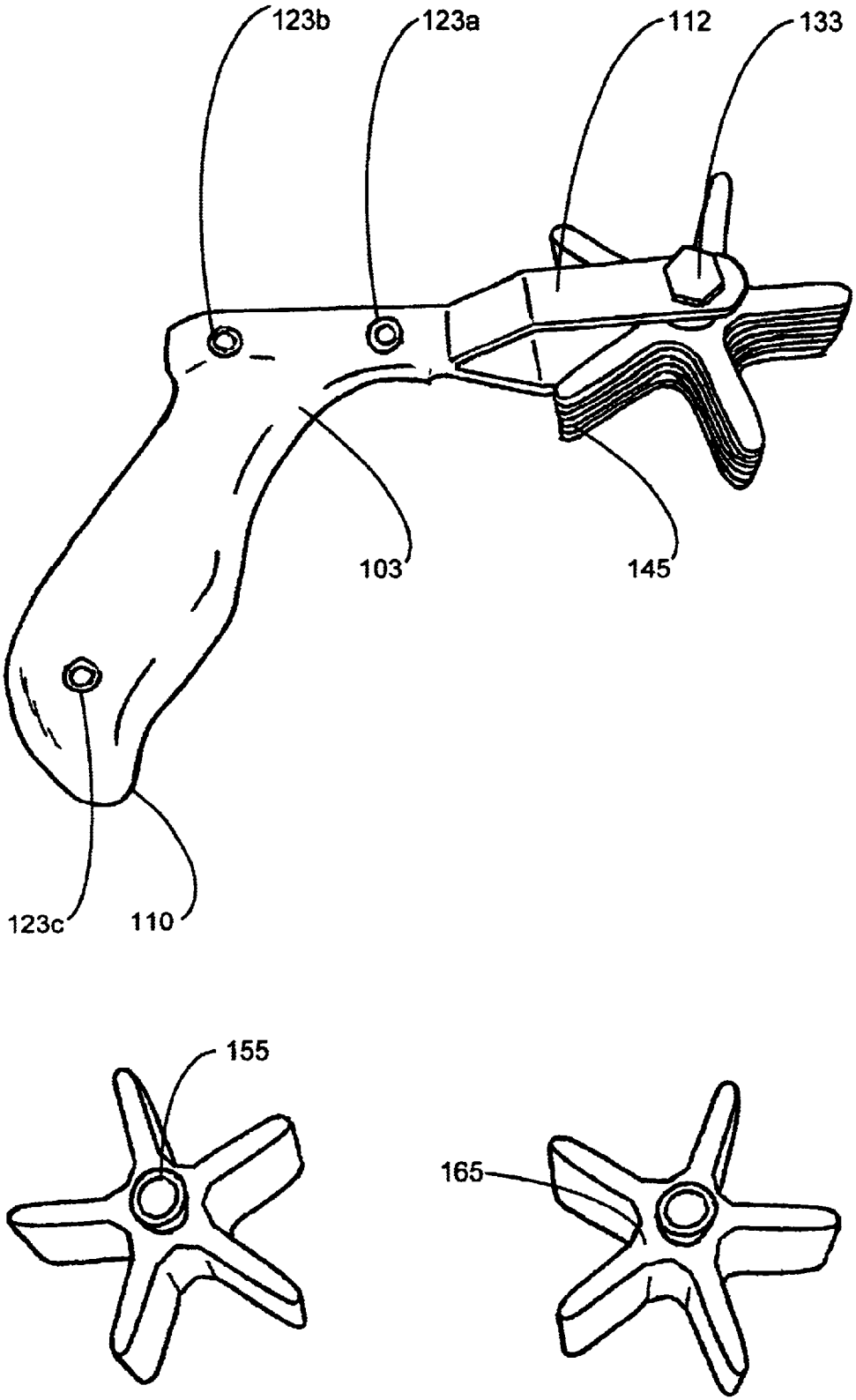
FIG. 1 shows a side view of a cleaning tool and cleaning paddle wheels of the present invention.

The cleaning tool 103 of the present invention preferably includes a pistol grip handle 110 and an integral tool supporting end 112. The handle and tool end are formed from two molded halves secured together with suitable connectors 123*a–c*. The tool is designed so the cleaning wheel 145, preferably configured as a paddle wheel, rotates on a shaft or axis 133.

The paddle cleaning wheel 145 is preferably configured such that each paddle of the wheel is dimensioned the same. In addition, each paddle of the wheel can optionally be in a tooth design. The cleaning wheel has a center orifice 155 or hub, allowing the wheel to rotate on the axis or shaft. The paddle cleaning wheel may have rounded, blunt, saw toothed, brush or square ends. Those of skill in the art will know of other configurations for the ends of the paddle cleaning wheel.

The paddle cleaning wheel preferably comprises a polymer. The paddle wheel is preferably a flexible polymeric wheel. Various polymers include, but are not limited to, urethane, polyurethane, and the like. Polyurethane is a class of synthetic materials made by copolymerizing an isocyanate and a polyhydric alcohol and is commonly used as hard inert coatings, and (polyurethane rubber) for diaphragms and seals. Polyurethane rubber is especially useful in the present invention.

In certain embodiments, the paddle cleaning wheel comprises at least two flexible paddles or blades, preferably at least three flexible paddles or blades, and more preferably, at least four flexible paddles or blades. In certain aspects, the paddle wheel has a hub portion, wherein the surface treatment portions (e.g., paddles, blades, and the like), are flexible and polymeric and are coupled to the hub portion. The paddle cleaning wheel is preferably mounted for rotation relative to the handle, wherein the paddle cleaning wheel has a hub portion with surface treatment portions comprising discrete flexible polymeric pieces (e.g., blades, paddles) connected to the hub, which are circularly spaced about a rotational axis of the wheel. In another aspect, a flexible polymeric piece is attached to the distal end of a paddle or blade that is made of a different material.

Figure 2:
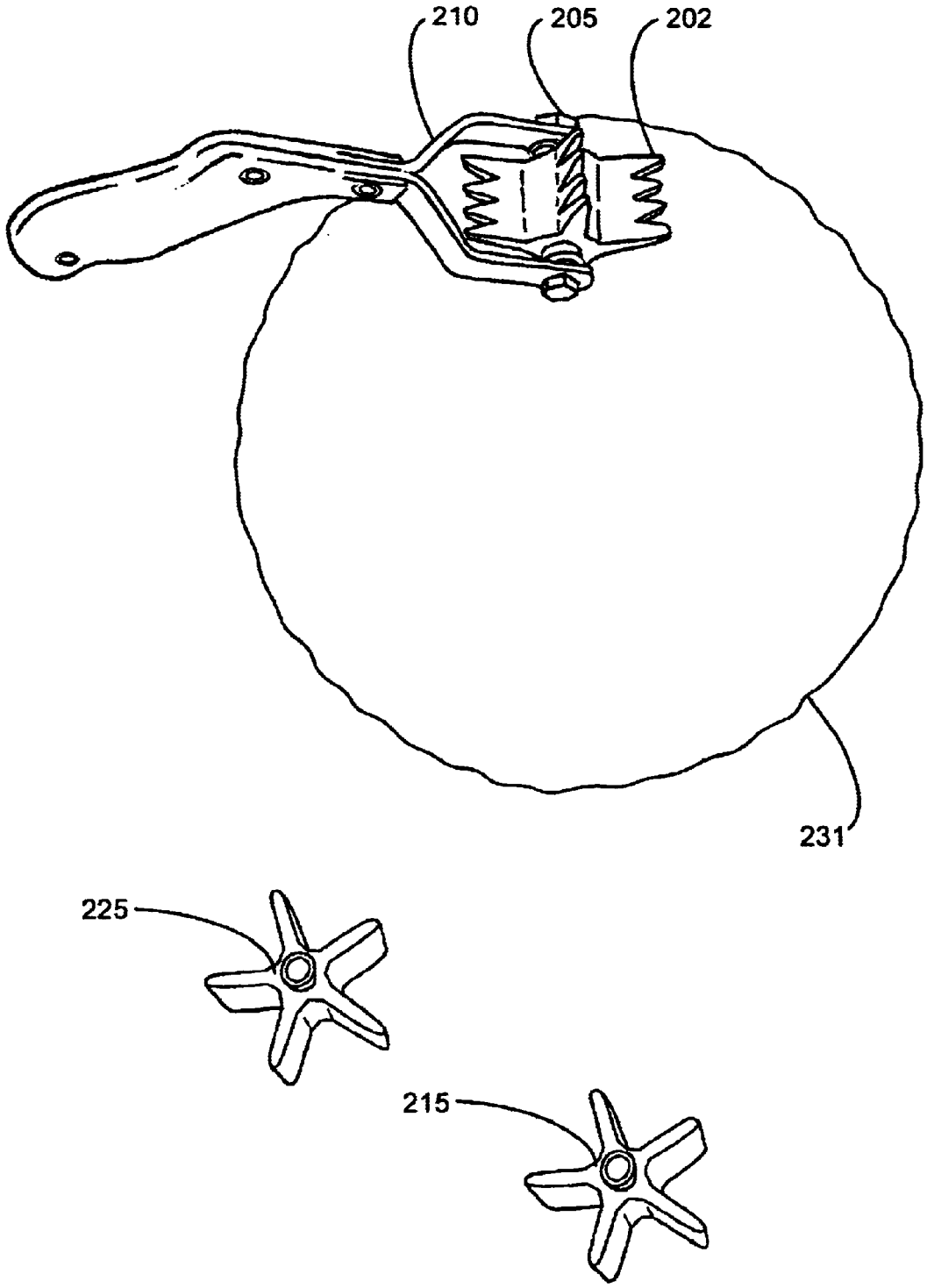
FIG. 2 shows a top view of a cleaning tool and cleaning paddle wheels of the present invention.

With reference to FIG. 2, a paddle cleaning wheel 202 having a saw tooth configuration at its end, is mounted on a common shaft 205 which is attached to the tool supporting end 210. The shaft 205 has its opposite ends supported in openings in the tool supporting end. The paddle cleaning wheel 202 is mounted for rotation on the shaft 205.

Referring to FIG. 2, the tool is held with the cleaning wheel 202 in direct engagement or contact with the surface of a buffing pad 231 mounted on a conventional pad support which, in turn, is mounted on a conventional power buffer or similar electric motor operated driving mechanism. The paddle cleaning wheel 202 is pressed on the surface of the pad 231 and is caused to rotate along with the driven rotation of the pad and effectively loosens soiling material which is adhering to the surface of the pad. The cleaning tool is operated by holding the same in operative contact with the rotatably driven pad.

In certain embodiments, the paddle cleaning wheel is a replaceable and or a disposable component of the hand held tool. Referring to FIG. 2, paddle cleaning wheels 215 and 225 comprise different polymer make-ups. Depending on certain soiling materials, one polymer may be better at cleaning than another polymer. In a preferred embodiment, polyurethane rubber is used. In certain aspects, the paddle cleaning wheel is a web of traction paddles or blades having blunt tips.

Figure 3:
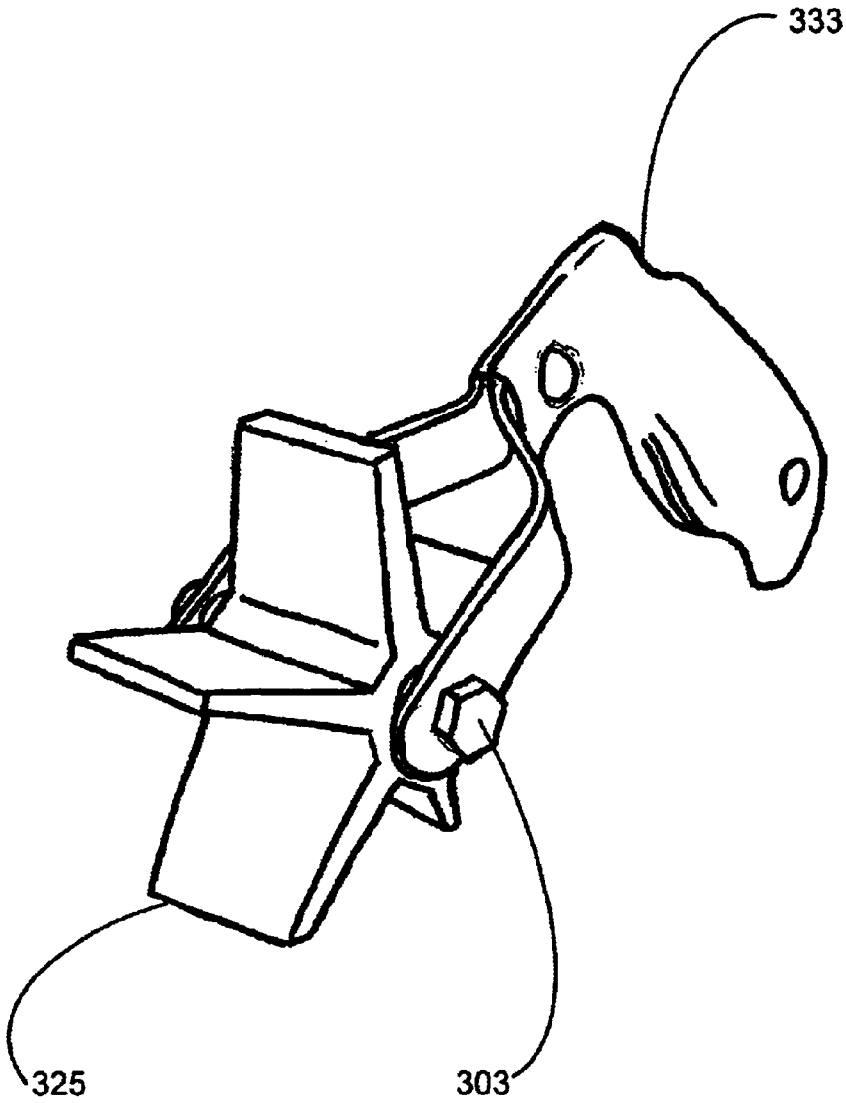
FIG. 3 shows a front view of cleaning tool of the present invention.

With reference to FIG. 3, a front view of a hand held cleaning tool for a foam buffing pad is shown with a pistol grip 333. The paddle cleaning wheel 325 is mounted on a common shaft 303 which is attached to the tool supporting end.

In another embodiment, the present invention provides a method for cleaning a soiled foam pad (e.g. buffing pad), comprising: contacting the soiled foam pad with a hand held cleaning tool having a paddle cleaning wheel, wherein the soiled foam pad is mounted and is rotatably driven; gripping the foam pad with the paddle cleaning wheel thereby cleaning the soiled foam pad. In a preferred embodiment, the paddle cleaning wheel cleans the soiled foam pad in a carpet-beating like action. In other words, each flexible polymeric blade or paddle of the paddle cleaning wheel slaps or strikes the foam pad causing the caked materials (e.g., paint, paint polishing compounds and the like) to fly out.

Figure 4:
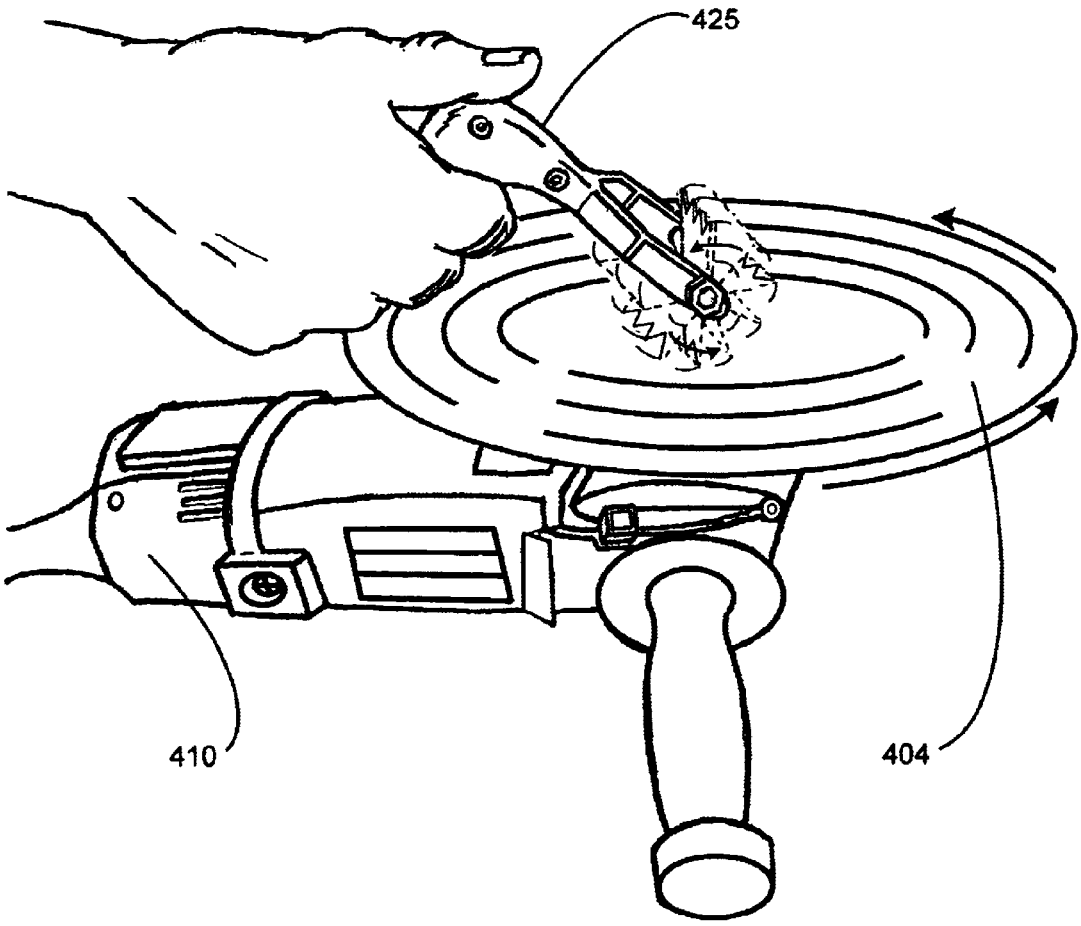
FIG. 4 shows the cleaning tool of the present invention in operative engagement with a foam buffing pad.

Referring to FIG. 4, in operation, the soiled foam pad 404 is mounted and is rotatably driven on for example, a hand held buffing tool 410. The hand held cleaning tool 425 grips the foam pad with the paddle cleaning wheel to clean the soiled foam pad in a carpet beating-like action. Conveniently, the operator holds the buffing tool with one hand and operates the cleaning tool with the other hand. The hand held cleaning tool in moved over the soiled pad until the pad is clean of debris. In a preferred embodiment, the paddle cleaning wheel grips the foam pad to open pores on the foam pad in a carpet-beating type action. The paddle wheel rotates in response to the movement of the buffing tool with each of the flexible polymeric blades or paddles striking the soiled pad to clean the pad. Preferably, the repetitive slapping or striking of each of the flexible polymeric blades beats the pad clean. In certain aspects, the paddle cleaning wheel's axis of rotation is parallel to the soiled foam pad wherein the flexible polymeric blades or paddles strike the soiled pad in a perpendicular fashion.

Various modes of carrying out the present invention are contemplated as being within the scope of the following claims particularly pointing out and distinctly claiming the subject matter which is regarded as the invention.

What is claimed is:

1. A hand held cleaning tool for a foam buffing pad, said tool comprising:

a handle;

a tool supporting end attached to and extending from one end of the handle; and a flexible paddle cleaning wheel mounted on a shaft attached to the tool supporting end, wherein said paddle cleaning wheel comprises a hub.

2. The tool of claim 1, wherein said paddle cleaning wheel comprises a polymer.

3. The tool of claim 1, wherein said paddle cleaning wheel comprises at least two flexible paddles coupled to said hub.

4. The tool of claim 1, wherein said hub has surface treatment portions comprising discrete flexible polymeric pieces connected to said hub.

5. The tool of claim 1, wherein said paddle cleaning wheel comprises leather.

6. The tool of claim 1, wherein said handle comprises a pistol grip.

7. A method for cleaning a soiled foam pad, said method comprising:

contacting said soiled foam pad with a hand held cleaning tool having a flexible paddle cleaning wheel, said paddle cleaning wheel comprising a hub, wherein said soiled foam pad is mounted and being rotatably driven;

gripping said foam pad with said paddle cleaning wheel thereby cleaning said soiled foam pad.

8. The method of claim 7, wherein said paddle cleaning wheel grips said foam pad to open pores on said foam pad.

9. The method of claim 7, wherein said paddle cleaning wheel grips said foam pad to open pores on said foam pad in a carpet-beating type action.

10. The method of claim 7, wherein said paddle cleaning wheel is configured as a brush.

11. The method of claim 7, wherein said paddle cleaning wheel comprises at least two flexible polymeric blades, wherein each of said at least two flexible polymeric blades strike the foam pad.

* * * * *